US006826900B2

(12) United States Patent
Rosenwasser et al.

(10) Patent No.: US 6,826,900 B2
(45) Date of Patent: Dec. 7, 2004

(54) NON ROUND FACETED HOLLOW LINK

(75) Inventors: David Rosenwasser, Norwood, NJ (US); Avi Rosenwasser, 100 Rio Vista Dr., Norwood, NJ (US) 07648

(73) Assignee: Avi Rosenwasser, Norwood, NJ (US)

( * ) Notice: Subject to any disclaimer, the term of this patent is extended or adjusted under 35 U.S.C. 154(b) by 150 days.

(21) Appl. No.: 10/073,660

(22) Filed: Feb. 11, 2002

(65) Prior Publication Data

US 2003/0150204 A1 Aug. 14, 2003

(51) Int. Cl.[7] ..... B21L 5/02
(52) U.S. Cl. ..... 59/80; 59/83
(58) Field of Search ..... 59/80, 83, 35.1, 59/82

(56) References Cited

U.S. PATENT DOCUMENTS

| | | | | |
|---|---|---|---|---|
| 5,125,225 | A | | 6/1992 | Strobel |
| 5,129,220 | A | | 7/1992 | Strobel |
| 5,303,540 | A | | 4/1994 | Rozenwasser |
| 5,353,584 | A | | 10/1994 | Strobel et al. |
| 5,408,820 | A | | 4/1995 | Strobel et al. |
| 5,437,149 | A | | 8/1995 | Strobel |
| 5,471,830 | A | * | 12/1995 | Gonzales ..... 59/80 |
| 5,487,264 | A | | 1/1996 | Strobel |
| 5,531,065 | A | * | 7/1996 | Rozenwasser ..... 59/80 |
| D376,119 | S | * | 12/1996 | Rozenwasser ..... D11/13 |
| 5,581,993 | A | | 12/1996 | Strobel |
| 5,737,910 | A | | 4/1998 | Rozenwasser |
| 5,797,258 | A | | 8/1998 | Strobel et al. |
| 5,966,922 | A | | 10/1999 | Cossio |
| 6,389,790 | B1 | * | 5/2002 | Rosenwasser et al. ..... 59/80 |
| D462,287 | S | * | 9/2002 | Rosenwasser et al. ..... D11/13 |
| 6,460,323 | B1 | * | 10/2002 | Rosenwasser et al. ..... 59/80 |
| 6,619,024 | B1 | | 9/2003 | Strobel et al. |

* cited by examiner

*Primary Examiner*—David Jones
(74) *Attorney, Agent, or Firm*—Katten Muchin Zavis Rosenman

(57) ABSTRACT

A non-annular, hollow chain link is provided with a gap and is capable of being intertwined to form a jewelry rope chain. The gap faces the widest dimension of the link, and faceting surfaces are preferably disposed adjacent the gap. When compared with an annular, prior art link having a diameter that is equivalent to the widest dimension of the non-annular link, the faceting surfaces present a greater faceting surface area than the faceting surfaces of such annular, prior art link. Thus, a faceted rope chain formed from such hollow, non-annular chain links will have a greater faceting presence and appearance than an equivalent rope chain formed from annular chain links.

17 Claims, 2 Drawing Sheets

NON ROUND FACETED HOLLOW LINK

FIELD OF THE INVENTION

This invention relates to hollow chain links capable of being intertwined to form a jewelry rope chain, and more specifically, to a hollow jewelry chain link that is faceted along an exposed surface that has a greater dimension than an exposed surface of a corresponding annular link, such that a jewelry rope chain formed from such hollow chain link has greater facets than a jewelry rope chain formed from hollow annular links.

BACKGROUND OF THE INVENTION

A method of deforming hollow chain links is described by Strobel in U.S. Pat. Nos. 5,125,225 and 5,129,220 and such patents' extensive progeny. Such patents are, however, limited to the processing of annular, toroidal links, where such links are limited to a round profile.

A method of diamond cutting of hollow chain links having an oval profile is described in the present inventors' U.S. Pat. No. 5,303,540, wherein a high luster surface is formed in an elongated depression along a portion of the outer perimeter of the link.

Other methods of faceting hollow rope chain are described in U.S. Pat. No. 5,966,922 to Cossio and U.S. Pat. No. 5,737,910 to Rozenwasser.

Thus, the faceting of round or annular, toroidal and certain oval hollow links are known. The faceting of such links are, however, limited by their specific shapes or configurations.

SUMMARY OF THE INVENTION

It is an object of the present invention is to create a faceted hollow chain link having the maximum amount of faceting along the outer periphery, which presents a highly lustrous appearance that is appealing to a wearer.

The term "faceting" as used herein describes a process whereby the outer periphery of a hollow chain link is provided with a flat, shiny surface. Usually, with respect to solid chain links, the term "faceting" is analogous to diamond cutting, wherein a portion of the outer wall of the chain link is cut away from the link body. With hollow chain links, this process of "faceting" becomes challenging because the outer wall is thin, and any uncontrolled cutting is likely to damage the integrity of the outer wall. Thus, the term "faceting" as applied to hollow chain links usually means deforming with a blunt instrument or a wheel or by any other means known in the art, such that the outer peripheral wall is moved inward or is deformed away from its original position, and not cut away completely like with diamond cutting of solid chain links. Such deformation or contouring is also known in the art as "simulated" faceting, as the final appearance of the hollow link, with a brilliant, lustrous surface, is similar to the appearance created by diamond cutting a solid chain link.

The present invention covers the "faceting" of any non-round, hollow, seamed or seamless link, having any cross section and utilizing any method of faceting as applied to hollow chain links, and a chain link and rope chain manufactured according to such method. Such hollow chain link has a gap and is particularly suited for intertwining with other hollow chain links to form a jewelry rope chain, as such "rope chain" is well defined in the art. The faceting of one, some or all of the links occurs after the links are intertwined into a rope chain.

Such hollow chain link is defined by a pair of axes defining two distinct link dimensions, i.e. a first dimension along a first axis extending from an edge of the link containing the gap to the opposing edge of the link, and a second dimension along a second axis running perpendicular to the first axis and to which the gap faces. In most cases, the first axis will run along a vertical, through the gap, or run parallel to the gap. Such axes are further defined in accordance with a "viable" rope chain construction such that the second axis is defined along a maximum dimension of the link, and such that the gap faces the dimension which defines the widest part of the rope chain. In other words, since the width of a completed rope chain is defined by the widest dimension of a constituent link, the gap in said constituent link is defined in a facing relationship to said widest dimension. The first axis bisecting the gap or running parallel thereto is preferably defined along a link dimension that is less than or equal to the widest dimension of the link. A chain link having a gap that faces the narrowest dimension of the link would not be intertwinable to form a "viable" rope chain, since the space available along the interior of the link would not be sufficient to accommodate the intertwining of other links therein, and any chain produced from the "intertwining" of such links would not be representative of a conventional "rope" chain.

The link of the invention is also provided with at least one surface that is exposed for faceting, such surface usually being defined adjacent the gap and not directly opposite thereto. Such exposed surface has a characteristic faceting surface dimension that is greater than a corresponding faceting surface dimension defined by an annular link having a diameter that is consistent with the widest dimension of the inventive link. In other words, if an annular link were superimposed on top of a link of the present invention, such that the widest dimension of the link of the present invention was the same value as the diameter of the annular link, the surface exposed for faceting on the link of the invention would be greater than an equivalent surface exposed for faceting and defined along an equivalent annular link superimposed thereon. As a result, a greater amount of faceting may be imparted to the hollow chain link of the invention as compared with an equivalently sized rope chain link having an annular configuration, resulting in a rope chain that is more lustrous and brilliant than a comparable rope chain formed from annular chain links.

DETAILED DESCRIPTION OF THE PREFERRED EMBODIMENTS

Figure 1:
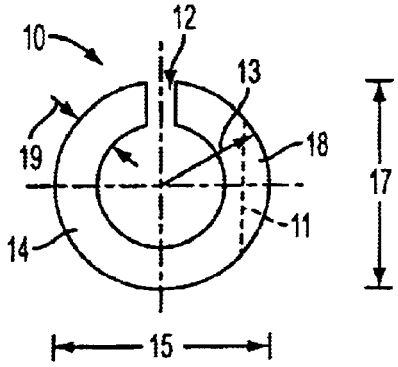
FIG. 1 PRIOR ART
FIG. 1 is a prior art, annular link capable of intertwining with other links to form a rope chain.
Figure 6:
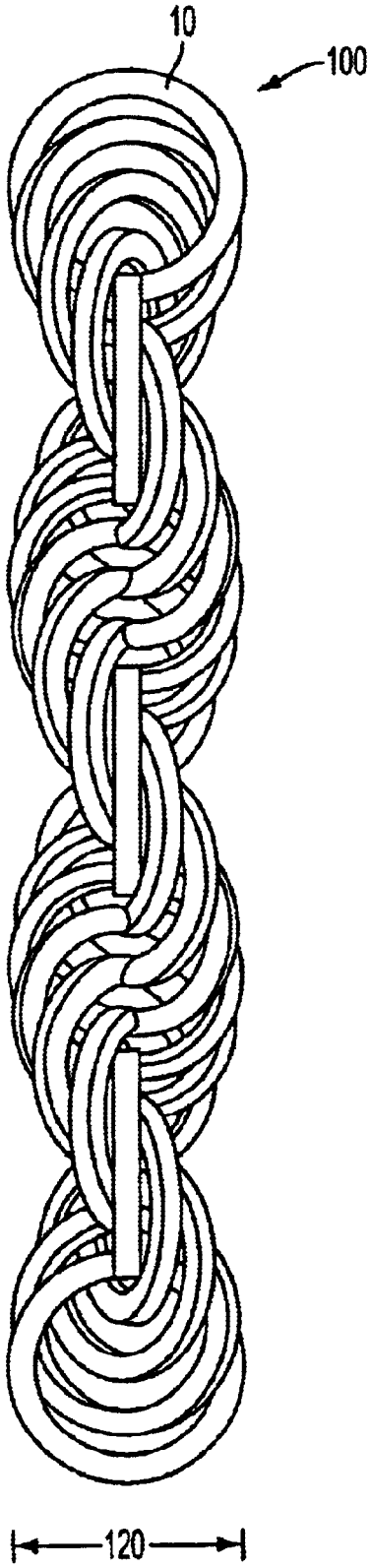
FIG. 6 is a side elevation of a rope chain formed from the link of FIG. 1.
Figure 7:
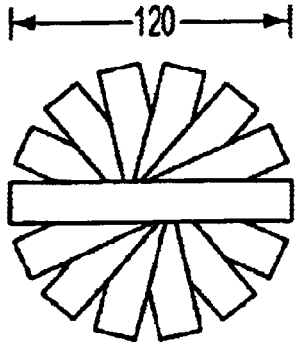
FIG. 7 is an edge view of the chain of FIG. 6.

FIG. 1 illustrates a prior art chain link 10 that is capable of intertwining with other chain links, via a gap 12, to form a jewelry rope chain. Link 10 has an annular profile, a side 16 opposite the gap 12, and lateral sides 14 and 18 that are exposed, when intertwined as part of a rope chain, for faceting. In general, a rope chain 100 as shown in FIGS. 6 and 7 created by intertwined links 10 will have a chain width 120 that is consistent with the diameter 15 defined between the sides 14, 18 that are exposed for faceting. Such diameter 15 is usually the longest dimension of the link 10 and is disposed in a facing relationship with the gap 12 (i.e. the gap 12 faces the diameter 15 as shown in FIG. 1). Such longest dimension 15 is usually along an axis defined between the outermost locations of the faceting sides 14, 18. In the case of an annular link 10 shown in FIG. 1, the dimension 17 that is aligned with the gap 12, or that is defined parallel to an axis that cuts through the gap 12 as shown, has the same dimension as the dimension 15. In the case of a non-annular link (discussed below) that is adapted for intertwining into a rope chain, dimension 15 is usually greater than dimension 17.

An annular link such as the link 10 illustrated in FIG. 1 usually has a limited faceting surface defined along sides 14 and 18. Since the radius of curvature 13 defined along sides 14 and 18 is the same at all locations, due to the annular profile of the link 10, the extent of faceting along such sides 14 and 18 is limited. Thus, FIG. 1 illustrates a prior art annular link 10 that, when intertwined to form a rope chain 100 as shown in FIGS. 6 and 7, defines a chain width 120 having a width dimension 15 and sides 14 and 18 that are exposed for faceting by conventional methods.

FIGS. 2-5 illustrate hollow chain links of the present invention that allow for greater faceting along the exposed sides as compared with an annular link of an equivalent widest dimension (to be described in more detail). The hollow chain links of the present invention, when intertwined to form a jewelry rope chain, present faceting surfaces that have a greater faceting dimension than an equivalent rope chain formed from annular chain links (see chain 100 of FIGS. 6 and 7). Thus a rope chain formed from the hollow links of the present invention, having a rope chain width that is equivalent to the widest dimension 15 of an annular link of FIG. 1, will be more brilliant with a greater faceted surface than a rope chain formed from the annular links of FIG. 1.

The following description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention. In the various views of the drawings, like reference characters designate like or similar parts.

Figure 2:
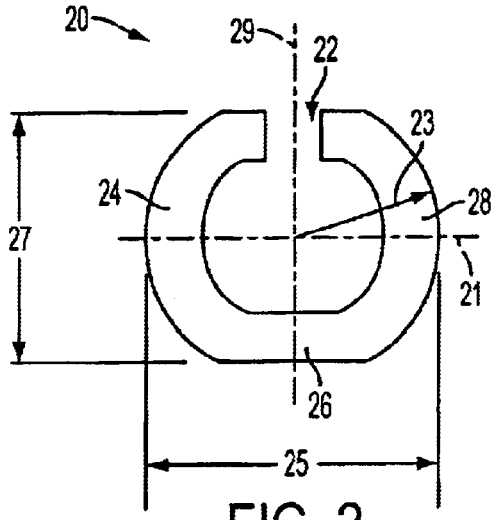
FIG. 2 is a first embodiment of a link of the present invention capable of intertwining with other links to form a rope chain.
Figure 3:
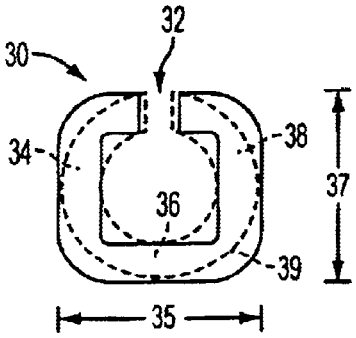
FIG. 3 is an alternative embodiment of the link of the invention.

FIG. 2 illustrates a hollow chain link 20 that is seamed or unseamed, and of any wire cross section, having an outer peripheral diameter 25 defining the widest dimension of the link 20. As compared with the link 10 of FIG. 1, dimension 25 would be the equivalent of dimension 15. Such dimension 25 is defined along an axis 21 defining the longest diameter or the like, i.e., between the outermost locations on sides 24 and 28 of the link 20 adjacent the gap 22, and not between the gap 22 and the side 26 opposite the gap. The lateral sides 24, 28 adjacent the gap 22 are presented for faceting, while the side 26 opposite the gap 22 preferably remains unfaceted. While in the link of FIG. 2, the longest dimension 25 intersects the sides that are subject to faceting, other link configurations are possible where the longest dimension does not intersect such sides, but still intersects the outermost locations of the link.

Since the link 20 is non-round or non-annular, and since 25 defines a dimension that is equivalent to the diameter 15 of a unit annular link 10, dimension 27, defined along an axis 29 between the gap 22 and opposite side 26, is smaller than dimension 25. Thus, radius 23 will have a value that is greater than the radius of a unit annular link 10 with a diameter equal to the dimension of length 25. Therefore, because the sides 24 and 28 are defined by an arc that is shallower than the arc 13 of an annular link 10, the dimension of the sides 24, 28 that is exposed for faceting is greater than if the link 20 were round or annular.

Thus, on any non-annular hollow link in accordance with the present invention, having a seam or being seamless, and having any cross section, the sides of the hollow link exposed for faceting shall have a surface dimension that provides for greater faceting than an equivalent annular link, by defining a faceting surface that exceeds the surface available for faceting along an equivalent annular link. This is exemplified by a comparison of the prior art, annular link 10 of FIG. 1 and the hollow chain link of FIG. 2. If the annular link 10 of FIG. 1 is superimposed over the hollow chain link 20 of FIG. 2, such that the widest dimension of the links 15 and 25 were the same, and such that the outermost edges of the sides 24 and 28 coincided with the outermost edges of sides 14 and 18, the shallower arcs defining the sides 24 and 28 of FIG. 2 will define a greater surface for faceting than the sides 14 and 18 of FIG. 1.

A variety of hollow link shapes satisfy such definition. For instance, with the non-annular hollow link 30 of FIG. 3, either of the sides 34, 38 adjacent the gap 32 that is subject to faceting has a greater faceting surface than any side defined by an annular link 39 (shown in phantom) having a diameter that is equivalent to the widest dimension 35 of such link 30. With the square hollow link of FIG. 3, the gap 32 faces the widest dimension 35, which may be greater than (not shown) or equal to (shown) the dimension 37 defined perpendicular to dimension 35. Again, the gap 32 should face the widest dimension 35 of the hollow chain link so as to produce a rope chain having a width that coincides with such widest dimension 35.

Figure 4:
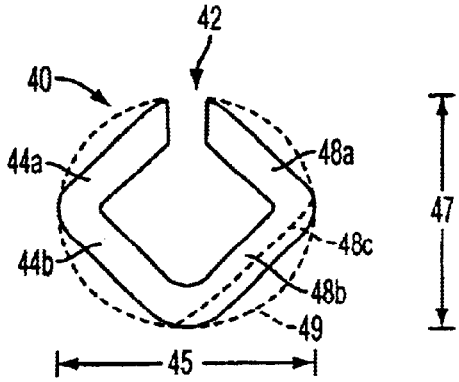
FIG. 4 is an alternative embodiment of the link of the invention.

With the non-annular hollow link 40 of FIG. 4, the gap 42 faces the widest dimension 45, which may be greater than or equal to dimension 47. The sides 44*a*, 44*b*, 48*a* and 48*b* adjacent the gap 42 define faceting surfaces that have a greater faceting potential, when such hollow link 40 is intertwined with other hollow links 40 to form a rope chain, than any of the sides of an equivalent annular link 49 having a diameter 15 (FIG. 1) that is equivalent to the widest dimension 45 of link 40. Thus, assuming that an equivalent annular link 49 is identical to the annular link 10 of FIG. 1, a sample facet 48*c* imparted to the side 48*b* of link 40 will have a surface dimension that is greater than, for example, a facet 11 (FIG. 1) along side 18 of link 10 (FIG. 1).

Figure 5:
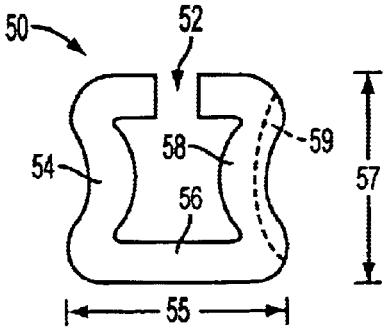
FIG. 5 is an alternative embodiment of the link of the invention.

An alternative non-annular hollow link of the present invention is illustrated in FIG. 5. With the link 50 of FIG. 5, the gap 52 faces the widest dimension 55, which may be greater than or equal to dimension 57. The sides 54 and 58 adjacent the gap 52 define faceting surfaces that have a greater faceting potential, when such link 50 is intertwined with other links 50 to form a rope chain, than any of the sides of an equivalent annular link having a diameter that is equivalent to the widest dimension 55 of link 50 (e.g., link 10 of FIG. 1 having a diameter 15 that is equivalent to the widest dimension 55 of link 50). Thus, assuming annular link 10 of FIG. 1 were superimposed over link 50 of FIG. 5, such that diameter 15 of link 10 was equivalent to dimension 55 of link 50, a sample facet 59 imparted to the side 58 of link 50 will have a surface dimension that is greater than, for example, a facet 11 (FIG. 1) along side 18 of link 10 (FIG. 1).

The non-annular hollow links of the present invention, when intertwined into a rope chain, present outer surfaces for faceting that have a larger faceting surface dimension than equivalently sized annular chain links. Such rope chain may be formed by intertwining chain links by hand, machine or by other methods known in the art. Thus, a completed rope chain formed from the hollow non-annular chain links of the invention that is faceted will be more lustrous and brilliant than a faceted rope chain formed from annular chain links.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

What is claimed is:

1. A jewelry rope chain formed from intertwined, non-annular, hollow rope chain links, at least one of said links comprising:

a) an outer periphery, an inner periphery and a gap, said gap for intertwining said chain link with other chain links, b) a first end opposite said gap, lateral sides adjacent said gap and an outer wall on at least one of said lateral sides deformed toward an inner wall on said lateral side without the loss of link material that results in the appearance of a faceted surface on said outer wall, c) a first dimension defined along a first axis extending from said gap to said first end opposite said gap, and d) a second dimension defined along a second axis running perpendicular to said first axis and extending across said lateral sides such, that said gap faces said second axis, said second dimension defining the width of said jewelry rope chain, e) said second dimension being greater than or equal to said first dimension, f) wherein said faceted surface has a faceting length that is greater than a faceting length defined along a faceted surface of an annular chain link having a diameter that is the same as said second dimension.

2. A jewelry rope chain in accordance with claim 1, wherein a portion of said outer periphery is curved.

3. A jewelry rope chain in accordance with claim 1, wherein a portion of said outer periphery is not curved.

4. A jewelry rope chain in accordance with claim 1, wherein said second dimension is greater than, and not equal to, said first dimension.

5. A jewelry rope chain in accordance with claim 1, wherein said faceted surface is disposed parallel to said first axis.

6. A jewelry rope chain in accordance with claim 1, wherein said faceted surface is disposed at an angle with respect to said first axis.

7. A jewelry rope chain in accordance with claim 1, wherein said faceted surface is disposed perpendicular to said second axis.

8. A jewelry rope chain in accordance with claim 1, wherein said faceted surface is disposed at an angle with respect to said second axis.

9. A jewelry rope chain in accordance with claim 1, wherein said faceted surface has a different shape than said first side opposite said gap.

10. A jewelry rope chain in accordance with claim 1, wherein both of said lateral sides are deformed to result in the appearance of a faceted surface.

11. A jewelry rope chain in accordance with claim 1, wherein a plurality of said chain links are deformed to result in the appearance of a faceted surface.

12. A jewelry rope chain in accordance with claim 1, wherein said at least one of said links further comprises a seam.

13. A jewelry rope chain in accordance with claim 1, wherein said at least one of said links is seamless.

14. A jewelry rope chain in accordance with claim 1, wherein said hollow rope chain links are intertwined by hand.

15. A jewelry rope chain in accordance with claim 1, wherein said hollow rope chain links are intertwined by machine.

16. A jewelry rope chain in accordance with claim 1, wherein at least some of said hollow rope chain links are intertwined by hand.

17. A jewelry rope chain in accordance with claim 1, wherein at least some of said hollow rope chain links are intertwined not by hand.

* * * * *